US010088249B2

(12) United States Patent
Lee et al.

(10) Patent No.: US 10,088,249 B2
(45) Date of Patent: Oct. 2, 2018

(54) HEAT EXCHANGE DEVICE

(71) Applicant: DELTA ELECTRONICS, INC., Taoyuan (TW)

(72) Inventors: Wu-Chi Lee, Taoyuan (TW); Tse-Hsin Wang, Taoyuan (TW); Ying-Chi Chen, Taoyuan (TW); Lee-Lung Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 15/168,969

(22) Filed: May 31, 2016

(65) Prior Publication Data

US 2017/0184353 A1 Jun. 29, 2017

(30) Foreign Application Priority Data

Dec. 29, 2015 (CN) ..... 2015 2 1125179

(51) Int. Cl.

| | |
|---|---|
| ***F24D 5/10*** | (2006.01) |
| ***F28F 13/06*** | (2006.01) |
| ***F28D 9/00*** | (2006.01) |
| ***F28D 21/00*** | (2006.01) |

(52) U.S. Cl.

CPC ..... *F28F 13/06* (2013.01); *F28D 9/00* (2013.01); *F28D 9/0093* (2013.01); *F28D 21/0001* (2013.01); *F28F 2250/08* (2013.01)

(58) Field of Classification Search

CPC ..... F28F 13/06; F28F 2250/08; F28D 9/00; F28D 9/0093; F28D 21/0001

See application file for complete search history.

(56) References Cited

U.S. PATENT DOCUMENTS

| | | | | |
|---|---|---|---|---|
| 2009/0052132 | A1* | 2/2009 | Fernandez | F28D 9/00 361/696 |
| 2012/0196523 | A1* | 8/2012 | Jiang | F24F 12/006 454/237 |
| 2015/0060032 | A1* | 3/2015 | Kwon | F24F 12/006 165/166 |
| 2016/0192601 | A1* | 7/2016 | Kao | A01G 9/246 47/17 |

* cited by examiner

*Primary Examiner* — Len Tran

*Assistant Examiner* — Gordon Jones

(74) *Attorney, Agent, or Firm* — Hauptman Ham, LLP

(57) ABSTRACT

A heat exchange device includes a housing, a heat exchange module, and a piezoelectric module. Isolated inner and outer circulation chambers are formed in the housing. The heat exchange module in the housing includes a stack of separated plates parallel to each other. An inner channel communicated with the inner circulation chamber and an outer channel communicated with the outer circulation chamber are defined respectively by both sides of one of the plates and the other adjacent plates. The piezoelectric module in the housing includes a piezoelectric chip, and first and second heat exchange sides thermally coupled to the piezoelectric chip. The first heat exchange side is located in the inner circulation chamber and the second heat exchange side is located in the outer circulation chamber, so that heat can be transferred between the inner and outer circulation chambers via the piezoelectric chip.

9 Claims, 6 Drawing Sheets

HEAT EXCHANGE DEVICE

FIELD OF THE INVENTION

The technical field relates to a heat exchange device, more particularly to a plate heat exchange device having a piezoelectric module.

BACKGROUND OF THE INVENTION

In general, a conventional plate heat exchanger exchanges heat by circulating an inner airflow (which is a hotter airflow) and an outer airflow (which is a colder airflow) on both sides of a plate respectively. During the heat transfer process, the plate heat exchanger does not input energy to a thermal system (such as in the application of a compressor of a refrigerator. The natural heat transfer requires driving the heat from a high-temperature position to a low-position temperature though a temperature gradient (or temperature difference), so that the heat can be transferred from a hotter inner airflow to a colder outer airflow.

In the conventional plate heat exchanger, the capability of thermal decomposition is directly proportional to the volume of the plate. In other words, the higher requirement for thermal decomposition, the larger the volume of the heat exchanger is required.

If the temperature of the outer airflow is higher than the temperature of the inner airflow, the hotter outer airflow is transferred to the colder inner airflow, so that the conventional plate heat exchanger cannot cool the inner airflow to a temperature lower than the temperature of the outer airflow (or room temperature).

In addition, the conventional plate heat exchanger just provides the effect of cooling the inner airflow only. If the system is required to supply hot airflow, an additional heater must be added to pre-heat the inner airflow, and thus a higher cost will be incurred.

In view of the aforementioned problems of the prior art, the discloser of this disclosure based on years of experience in the related industry to conduct extensive researches and experiments, and finally provided a feasible solution to overcome the problems of the prior art.

SUMMARY OF THE INVENTION

It is a primary objective of this disclosure to provide a plate heat exchange device having a piezoelectric module.

To achieve the aforementioned and other objectives, this disclosure provides a heat exchange device, comprising a housing, a heat exchange module and a piezoelectric module. The housing contains an inner circulation chamber and an outer circulation chamber formed therein and separated from each other. The heat exchange module is installed in the housing and includes a plurality of plates stacked and separated from each other, and both sides of at least one of the plates and another adjacent plate are enclosed to form an inner channel communicated with the inner circulation chamber and an outer channel communicated with the outer circulation chamber. The piezoelectric module is installed in the housing and includes a piezoelectric chip, and the piezoelectric module has a first heat exchange side and a second heat exchange side thermally coupled to the piezoelectric chip, and the first heat exchange side is disposed in the inner circulation chamber and the second heat exchange side is disposed in the outer circulation chamber, so that heat can be transferred between the inner circulation chamber and the outer circulation chamber via the piezoelectric chip.

The piezoelectric module has a pair of fin modules installed on the first heat exchange side and the second heat exchange side and disposed in the inner circulation chamber and the outer circulation chamber respectively, and both sides of the piezoelectric chip are respectively and thermally coupled to the fin modules. Both sides of the piezoelectric chip are attached to the fin modules respectively.

Each of the inner circulation chamber and the outer circulation chamber may have a fan installed therein, and the pair of fans can be operated independently. The housing has a division plate installed therein and enclosed to form the inner circulation chamber and the outer circulation chamber. The piezoelectric chip of the piezoelectric module is penetrated through the division plate in the housing, so that both sides of the piezoelectric chip are disposed in the inner circulation chamber and the outer circulation chamber respectively.

The heat exchange module in the inner circulation chamber is enclosed to form an inner intake chamber. The heat exchange module in the inner circulation chamber is enclosed to form an inner outlet chamber. The first heat exchange side of the piezoelectric module is disposed in the inner intake chamber. The housing has an inner intake port and an inner outlet port communicated with the inner circulation chamber.

The heat exchange module in the outer circulation chamber is enclosed to form an outer inlet chamber. The heat exchange module in the outer circulation chamber is enclosed to form an outer exhaust chamber. The second heat exchange side of the piezoelectric module is disposed in the outer inlet chamber. The second heat exchange side of the piezoelectric module is disposed in the outer exhaust chamber. The housing has an outer intake port and an outer exhaust port communicated with the outer circulation chamber.

DESCRIPTION OF THE PREFERRED EMBODIMENTS

Figure 1:
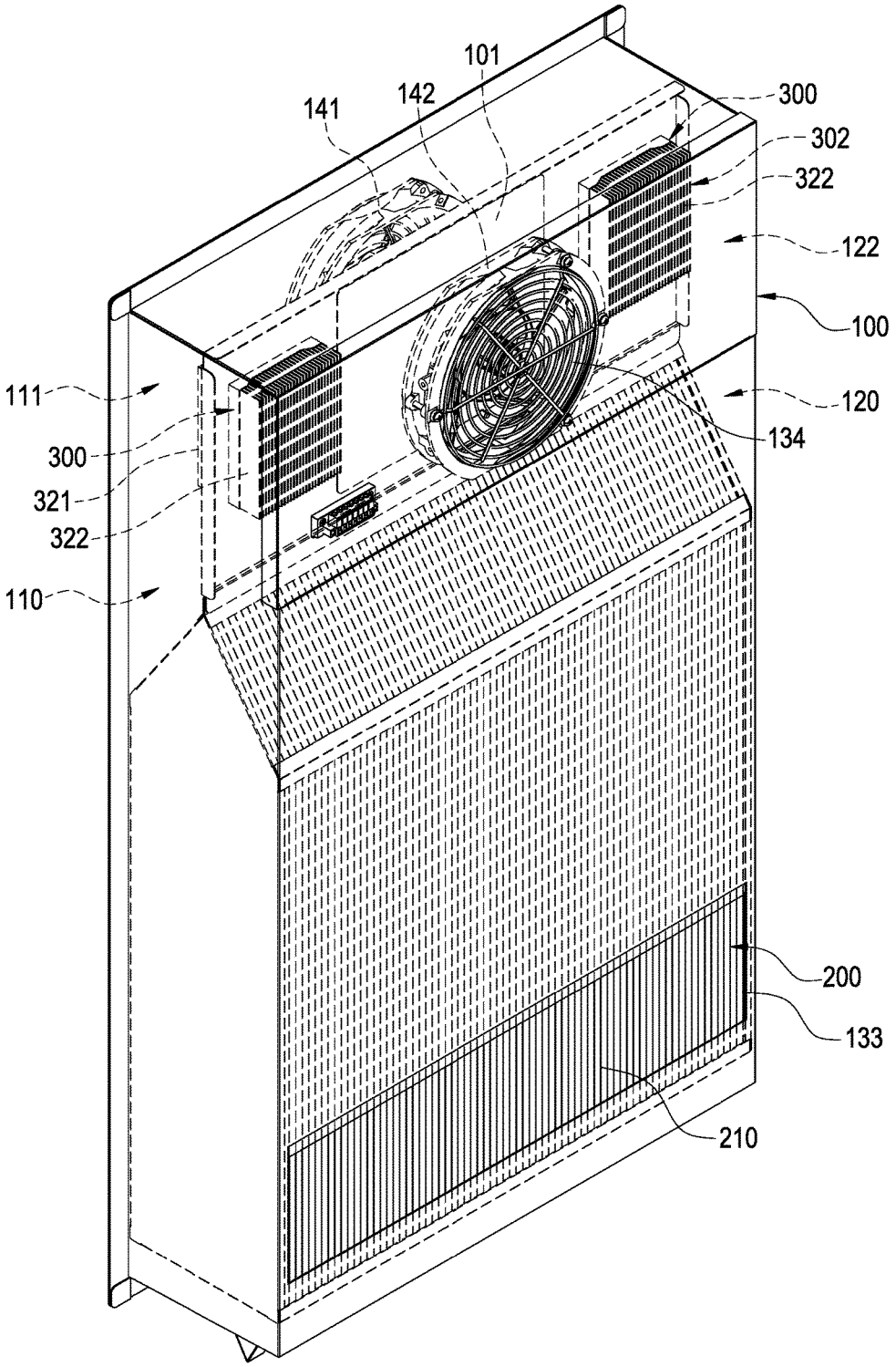
FIG. 1 is a first schematic view of a heat exchange device in accordance with a first preferred embodiment of this disclosure.
Figure 2:
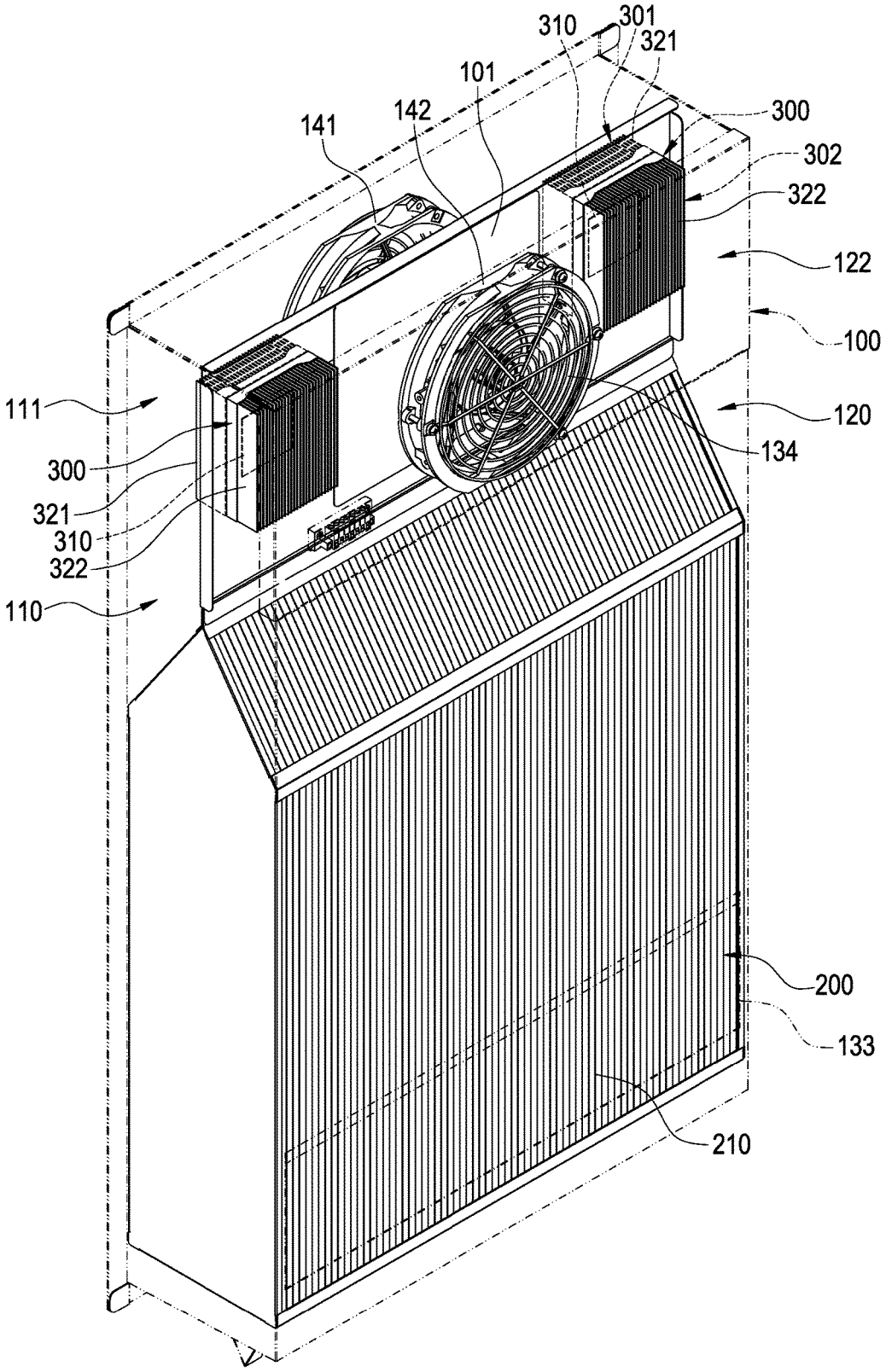
FIG. 2 is a second schematic view of a heat exchange device in accordance with the first preferred embodiment of this disclosure.
Figure 3:
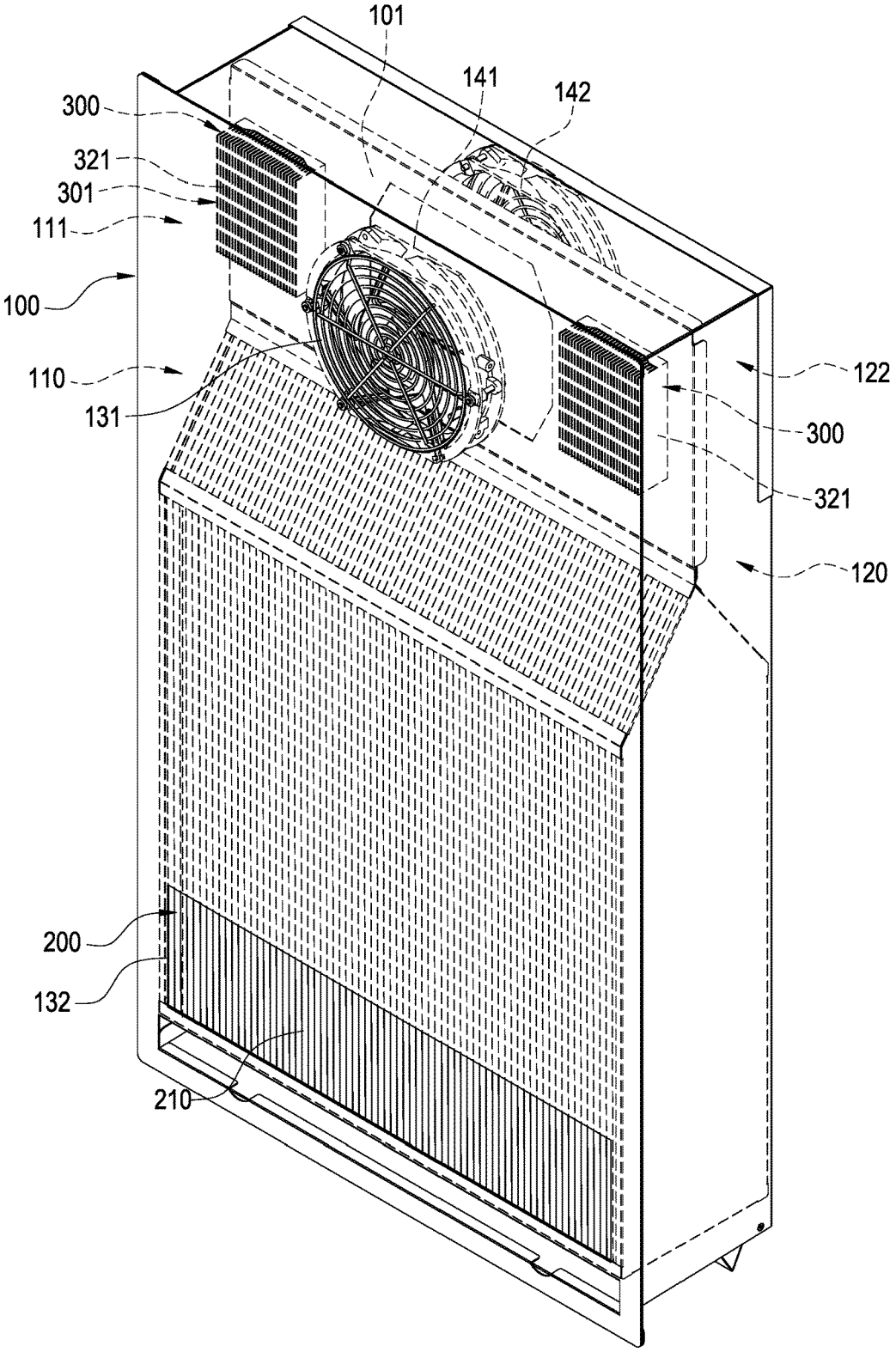
FIG. 3 is a third schematic view of a heat exchange device in accordance with the first preferred embodiment of this disclosure.
Figure 4:
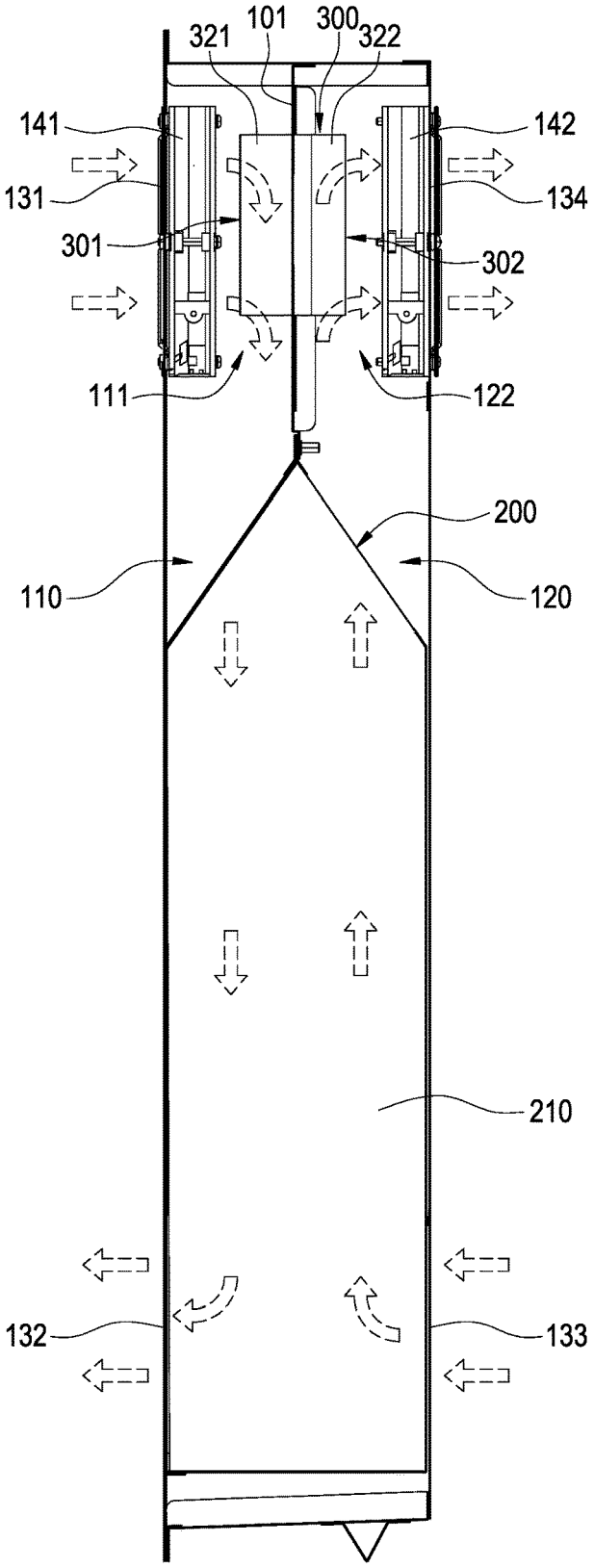
FIG. 4 is a fourth schematic view of a heat exchange device in accordance with the first preferred embodiment of this disclosure.

The technical contents of this disclosure will become apparent with the detailed description of preferred embodiments accompanied with the illustration of related drawings as follows. It is intended that the embodiments and figures disclosed herein are to be considered illustrative rather than restrictive.

With reference to FIGS. 1 to 4 for a heat exchange device in accordance with the first preferred embodiment of this disclosure, the heat exchange device comprises a housing 100, a heat exchange module 200, and a plurality of piezoelectric modules 300.

In this embodiment, the housing 100 is preferably made of metal, but this disclosure is not limited to such arrangement only. The housing 100 preferably has an inner circulation chamber 110 and an outer circulation chamber 120 formed therein by enclosing the division plate 101, and the inner circulation chamber 110 and the outer circulation chamber 120 are separated from each other. The housing 100 has an inner intake port 131, an inner outlet port 132, an outer intake port 133 and an outer exhaust port 134 formed thereon.

The heat exchange module 200 is installed in the housing 100 and includes a plurality of metal plates 210 stacked and separated from one another, and both sides of at least one of the plates 210 and other adjacent plates 210 are enclosed to form an inner channel (not labeled in the figures) and an outer channel (not labeled in the figures). Therefore, a plurality of inner channels and a plurality of outer channels are formed and passed between the plates 210, and the inner channel and the outer channel are separated from each other. A portion of the heat exchange module 200 is disposed in the inner circulation chamber 110, and the heat exchange module 200 in the inner circulation chamber 110 is enclosed to form an inner intake chamber 111, and the inner channel is communicated with the inner intake chamber 111 and the inner outlet port 132. A portion of the heat exchange module 200 is disposed in the outer circulation chamber 120, and the heat exchange module 200 in the outer circulation chamber 120 is enclosed to form an outer exhaust chamber 122, and the outer channel is communicated with the outer exhaust chamber 122 and the outer intake port 133. The inner intake port 131 is communicated with the inner intake chamber 111, and the outer exhaust port 134 is communicated with the outer exhaust chamber 122. Each of the inner intake chamber 111 and the outer exhaust chamber 122 contains a fan 141/142 installed therein and the pair of fans 141/142 is configured to be corresponsive to the inner intake port 131 and the outer exhaust port 134.

The pair of fans 141/142 comes with a suction design and an exhaust design respectively and are provided for driving inner and outer airflows. The fan 141 drives the inner airflow to enter into the inner intake chamber 111 from the inner intake port 131 and pass through the inner channel, and then flow out from the housing 100 through the inner outlet port 132. The fan 142 drives the outer airflow to pass through the outer channel from the outer intake port 133 and then enter into the outer exhaust chamber 122, and flow out from the housing 100 through the outer exhaust port 134. Therefore the inner airflow and the outer airflow separated from each other can exchange heat via the plate 210.

The piezoelectric module 300 is installed in the housing 100, and each piezoelectric module 300 includes a piezoelectric chip 310, and the piezoelectric chip 310 is preferably penetrated through the division plate 101 in the housing 100, so that both sides of the piezoelectric chip 310 are disposed in the inner intake chamber 111 and the outer exhaust chamber 122 respectively. Each piezoelectric module 300 has a first heat exchange side 301 and a second heat exchange side 302 respectively and thermally coupled to the piezoelectric chip 310, and the first heat exchange side 301 is disposed in the inner intake chamber 111 and the second heat exchange side 302 is disposed in the outer exhaust chamber 122. The piezoelectric module 300 includes a pair of fin modules 321/322 installed on the first heat exchange side 301 and the second heat exchange side 302 respectively, so that the pair of fin modules 321/322 is disposed in the inner intake chamber 111 and the outer exhaust chamber 122 respectively, and both sides of the piezoelectric chip 310 are thermally coupled to the fin modules 321/322 respectively, so that heat can be transferred between the inner intake chamber 111 and the outer exhaust chamber 122 via the piezoelectric chip 310.

Figure 5:
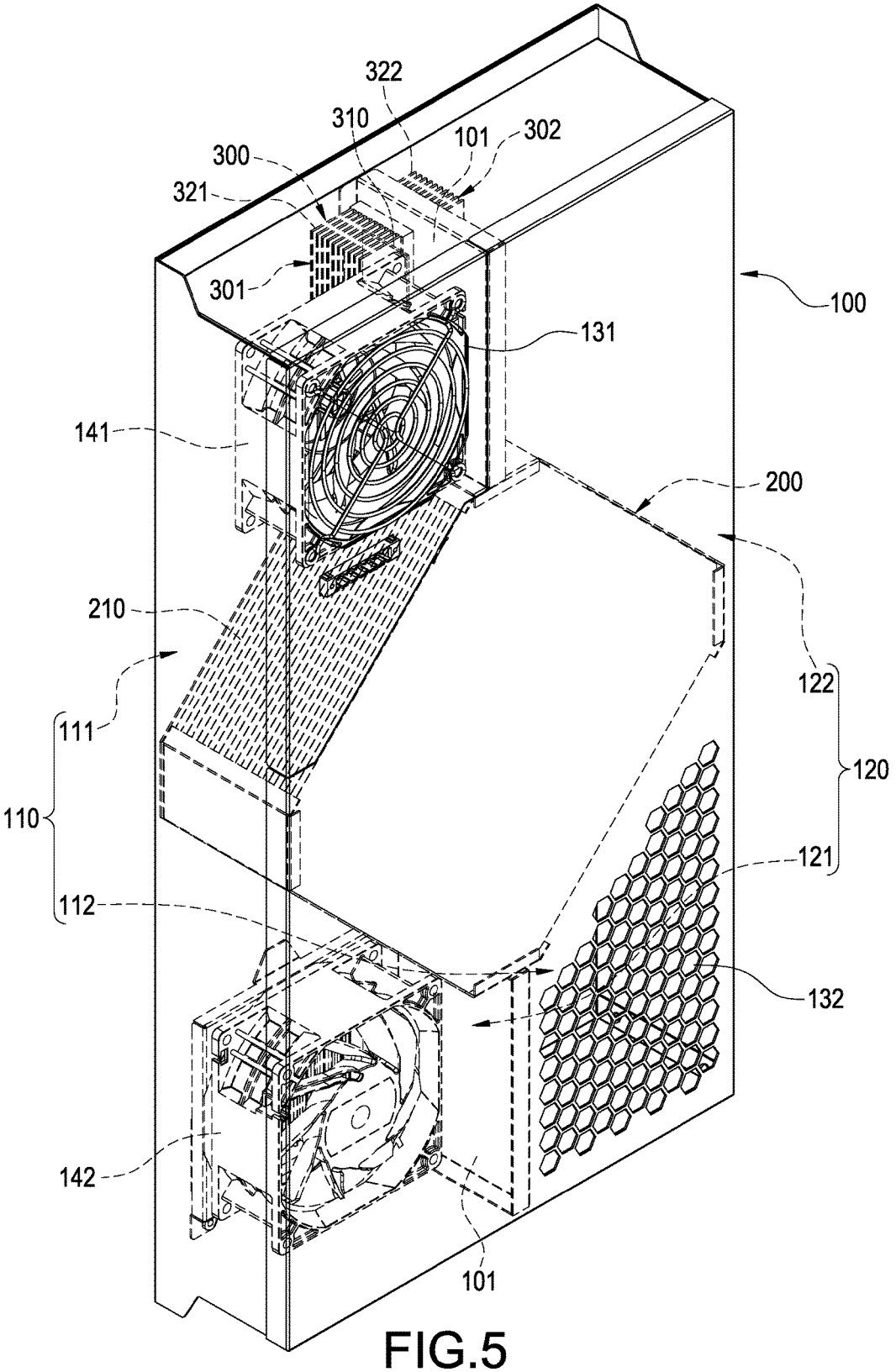
FIG. 5 is a first schematic view of a heat exchange device in accordance with a second preferred embodiment of this disclosure.
Figure 6:
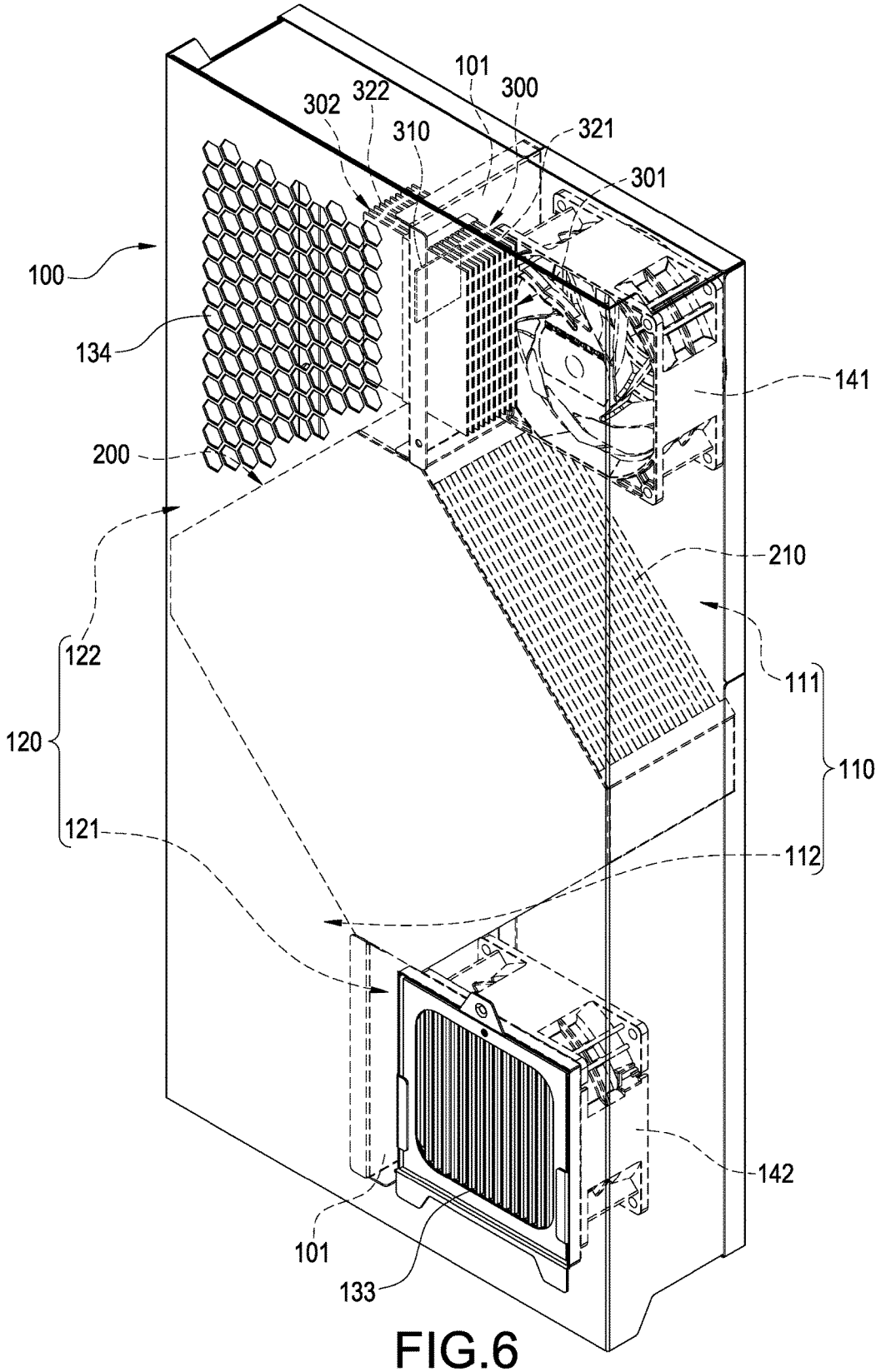
FIG. 6 is a second schematic view of a heat exchange device in accordance with the second preferred embodiment of this disclosure.

With reference to FIGS. 5 and 6 for a heat exchange device in accordance with the second preferred embodiment of this disclosure, the heat exchange device comprises a housing 100, a heat exchange module 200, and a piezoelectric module 300.

In this embodiment, the housing 100 is preferably made of metal, but this disclosure is not limited to such arrangement only. The housing 100 preferably has an inner circulation chamber 110 and an outer circulation chamber 120 formed by enclosing the division plate 101, and the inner circulation chamber 110 and the outer circulation chamber 120 are separated to each other. The housing 100 has an inner intake port 131, an inner outlet port 132, an outer intake port 133, and an outer exhaust port 134 formed thereon.

The heat exchange module 200 is installed in the housing 100, and the heat exchange module 200 includes a plurality of metal plates 210 stacked and separated from one another, and both sides of at least one of the plates 210 and other adjacent plates 210 are enclosed to form an inner channel (not labeled in the figures) and an outer channel (not labeled in the figures). Therefore, a plurality of inner channels and a plurality of outer channels are formed and passed between the plates 210, and the inner channel and the outer channel are separated from each other. A portion of the heat exchange module 200 is disposed on the inner circulation chamber 110, and the heat exchange module 200 in the inner circulation chamber 110 is enclosed to form an inner intake chamber 111 and an inner outlet chamber 112, and the inner channel is communicated with the inner intake chamber 111 and the inner outlet chamber 112. A portion of the heat exchange module 200 is disposed in the outer circulation chamber 120, and the heat exchange module 200 in the outer circulation chamber 120 is enclosed to form an outer inlet chamber 121 and an outer exhaust chamber 122, and the outer channel is communicated with the outer inlet chamber 121 and the outer exhaust chamber 122. The inner intake port 131 is communicated with the inner intake chamber 111, and the inner outlet port 132 is communicated with the inner outlet chamber 112, and the outer intake port 133 is communicated with the outer inlet chamber 121, and the outer exhaust port 134 is communicated with the outer exhaust chamber 122. Each of the inner intake chamber 111 and the outer inlet chamber 121 has a fan 141/142 installed therein, and the pair of fans 141/142 is configured to be corresponsive to the inner intake port 131 and the outer intake port 133 respectively.

The pair of fans 141 drives the inner airflow to enter into the inner intake chamber 111 from the inner intake port 131 and pass through the inner channel and then pass through the inner outlet port 132 from the inner outlet chamber 112 and flow out from the housing 100. The fan 142 drives the outer airflow to enter into the outer inlet chamber 121 from the outer intake port 133 and pass through the outer channel, and then pass through the outer exhaust port 134 from the outer exhaust chamber 122 and flow out from the housing 100. Therefore, the inner airflow and the outer airflow separated from each other can exchange heat via the plate 210.

The piezoelectric module 300 is installed in the housing 100, and each piezoelectric module 300 includes a piezoelectric chip 310, and the piezoelectric chip 310 is preferably penetrated through the division plate 101 in the housing 100, so that both sides of the piezoelectric chip 310 are disposed in the inner intake chamber 111 and the outer exhaust chamber 122 respectively. The piezoelectric module 300 has a first heat exchange side 301 and a second heat exchange side 302 thermally coupled to piezoelectric chip 310, and the first heat exchange side 301 is disposed in the inner intake chamber 111, and the second heat exchange side 302 is disposed in the outer exhaust chamber 122. The piezoelectric module 300 includes a pair of fin modules 321/322 installed on the first heat exchange side 301 and the second heat exchange side 302 respectively, so that the pair of fin modules 321/322 is disposed in the inner intake chamber 111 and the outer exhaust chamber 122, and both sides of the piezoelectric chip 310 are thermally coupled to the fin modules 321/322 respectively, so that heat can be transferred between the inner intake chamber 111 and the outer exhaust chamber 122 via the piezoelectric chip 310.

In the foregoing embodiments, a piezoelectric module 300 may be installed additionally to the division plate 101 between the inner circulation chamber 110 and the outer circulation chamber 120 of the heat exchange device of this disclosure. When the piezoelectric module 300 is not operated, the temperature difference of the inner airflow (which is a hotter airflow) and the outer airflow (which is a colder airflow) drives the heat to be transferred from the inner airflow to the outer airflow. The inner airflow exchanges heat with the outer airflow via the plate 210 while passing through the fin module 321/322 of the piezoelectric module 300, so as to exchange heat via the fin module 321/322 and improve the capability of heat decomposition of the heat exchange device. Therefore, the heat exchange device of this disclosure provides a better heat decomposition than the prior art without increasing the size of the plate 210.

When the piezoelectric module 300 is operated, the heat exchanger exchanges heat via the plate 210, and further transfers the heat from the inner circulation chamber 110 to the outer circulation chamber 120 via the piezoelectric chip 310 and cools the inner airflow passing through the fin module to further improve the capability of heat decomposition. In addition, the piezoelectric chip 310 can cool the inner airflow to a temperature lower than the temperature of the outer airflow. The conventional plate heat exchange device cannot achieve the aforementioned effects.

Both sides of the piezoelectric chip 310 may carry voltages of corresponsive polarities according to different requirements, so that the piezoelectric module 300 can be used to transfer energy from the outer circulation chamber 120 to the inner circulation chamber 110 for heating the inner airflow for the use in a heating device. On the other hand, the conventional heat exchange device requires the installation of an additional heater configured to be corresponsive to the plate 210, and thus incurs a higher cost. Since the pair of fans 141/142 can be operated independently, therefore the inner airflow and the outer airflow can be circulated independently. When it is necessary to avoid the loss of heat energy of the inner airflow, the fan 142 is turned off to stop the circulation of the outer airflow, and the piezoelectric module 300 is used for heating the circulated inner airflow.

While this disclosure has been described by means of specific embodiments, numerous modifications and variations could be made thereto by those skilled in the art without departing from the scope and spirit of this disclosure set forth in the claims.

What is claimed is:

1. A heat exchange device, comprising:

a housing, containing an inner circulation chamber and an outer circulation chamber formed therein and separated from each other;

a heat exchange module, installed in the housing, and including a plurality of plates stacked and separated from each other, and both sides of at least one of the plates and other adjacent plates being enclosed to form an inner channel communicated with the inner circulation chamber and an outer channel communicated with the outer circulation chamber; and at least a piezoelectric module, installed in the housing, and including a piezoelectric chip, and the piezoelectric module having a first heat exchange side and a second heat exchange side thermally coupled to the piezoelectric chip, and the first heat exchange side being disposed in the inner circulation chamber, and the second heat exchange side being disposed in the outer circulation chamber, such that heat can be transferred between the inner circulation chamber and the outer circulation chamber via the piezoelectric chip, wherein an inner intake chamber and an inner outlet chamber is formed in the inner circulation chamber and the inner channel is communicated between the inner intake chamber and the inner outlet chamber, wherein an outer inlet chamber and an outer exhaust chamber is formed in the outer circulation chamber and the outer channel is communicated between the outer inlet chamber and the outer exhaust chamber, wherein one of a pair of fans and the first heat exchange side of the piezoelectric module is disposed in the inner intake chamber, the second heat exchange side of the piezoelectric module is disposed in the outer exhaust chamber, and wherein the other of the pair of fans is disposed in the outer inlet chamber.

2. The heat exchange device according to claim 1, wherein the piezoelectric module includes a pair of fin modules installed on the first heat exchange side and the second heat exchange side and disposed in the inner circulation chamber and the outer circulation chamber respectively, and both sides of the piezoelectric chip being respectively and thermally coupled to the fin modules.

3. The heat exchange device according to claim 2, wherein both sides of the piezoelectric chip are attached onto the fin modules respectively.

4. The heat exchange device according to claim 1, wherein the pair of fans is operated independently.

5. The heat exchange device according to claim 1, wherein the housing has a division plate disposed therein and enclosed to form the inner circulation chamber and the outer circulation chamber.

6. The heat exchange device according to claim 5, wherein the piezoelectric chip of the piezoelectric module is configured to penetrate the division plate in the housing, so that both sides of the piezoelectric chip are disposed in the inner circulation chamber and the outer circulation chamber respectively.

7. The heat exchange device according to claim 1, wherein the heat exchange module in the inner circulation chamber is enclosed to form an inner outlet chamber.

8. The heat exchange device according to claim 1, wherein the housing has an inner intake port and an inner outlet port formed therein and communicated with the inner circulation chamber.

9. The heat exchange device according to claim 1, wherein the housing has an outer intake port and an outer exhaust port formed thereon and communicated with the outer circulation chamber.

* * * * *